US006045389A

United States Patent [19]

Ferrill et al.

[11] Patent Number: 6,045,389

[45] Date of Patent: Apr. 4, 2000

[54] CONTACT AND CONNECTOR FOR TERMINATING A PAIR OF INDIVIDUALLY INSULATED WIRES

[75] Inventors: Jess Britton Ferrill, Madison; Terry Lee Pitts, Greensboro, both of N.C.

[73] Assignee: The Whitaker Corporation, Wilmington, Del.

[21] Appl. No.: 09/109,278

[22] Filed: Jun. 30, 1998

[51] Int. Cl.[7] ..... H01R 4/24

[52] U.S. Cl. ..... 439/398; 439/404

[58] Field of Search ..... 439/394, 395, 439/404, 405, 408, 417, 660

[56] References Cited

U.S. PATENT DOCUMENTS

| | | | |
|---|---|---|---|
| 4,317,608 | 3/1982 | Dechelette | 439/403 |
| 4,527,852 | 7/1985 | Dechelette | 439/398 |
| 4,772,234 | 9/1988 | Cooper | 439/398 |
| 4,895,531 | 1/1990 | Vignoli | 439/398 |

*Primary Examiner*—Michael L. Gellner
*Assistant Examiner*—Antoine Ngandjui

[57] ABSTRACT

Plug and jack connector assemblies (20, 24) having internal shields (34, 108) separating pairs of connections, and grounding arrangements insuring continuity of ground between the mated assemblies. Within each assembly an interior shield comprises a unitary conductive member having a cross-shaped cross section dividing the interior of the assembly into quadrants. The assemblies are adapted to make eight separate connections, divided into pairs, for use with cabling made up of four twisted pairs (44). Each set of two connections is disposed within one of the quadrants defined by the interior shield, so that it is isolated from all the other connection pairs. The plug connector assembly includes a grounding bracket (32) securely attached to the outer shield (42) of its associated cable (22). The grounding bracket securely engages the conductive housing (102) of the mating jack connector assembly, which in turn is in contact with the outer shield (114) of its associated cable (26). Insulation displacing contacts (106) for engaging each twisted pair are housed in longitudinally offset cavities (190, 192) and are in opposed facing relation to each other so that each contact only conductively engages a respective one of the two twisted pair wires.

6 Claims, 8 Drawing Sheets

CONTACT AND CONNECTOR FOR TERMINATING A PAIR OF INDIVIDUALLY INSULATED WIRES

BACKGROUND OF THE INVENTION

This invention relates to a connector assembly terminating a pair of individually insulated wires and, more particularly, to an improved contact for use in such an assembly.

Local area networks interconnecting computers in a workplace are becoming more prevalent. One of the factors limiting the speed with which the computers can communicate over the network is the type of transmission medium connecting the computers to the network. For reasons of economy, twisted pair shielded cable has been developed that provides a sufficiently high data transfer rate. One such proposed type of cable is known as Category 7 twisted pair cable. Category 7 cable includes four pairs of individually insulated wires which are twisted together with a very tightly controlled twist specification. Each twisted pair is covered with its own individual conductive shield. All of the pairs are then bundled together and covered with a common shield. Typically, both the individual shields and the common shield are grounded. The common shield is covered with an outer plastic protective jacket.

Present day connectors used for high speed data transmission are normally constructed with side-by-side insulation displacing connection terminals which require that the wire pair be separated for termination. This separation creates impedance mismatches at high frequencies, thereby affecting transmission quality. It would therefore be desirable to have a connector with insulation displacing connection terminals which do not require the separation of the individual wires of the twisted pair.

SUMMARY OF THE INVENTION

According to the present invention, there is provided a conductive contact for use in a wire pair terminating connector which comprises a major body portion and a terminal portion. The major body portion has a forward mating section and a rear section. The terminal portion is at an end of the rear section and includes an insulation displacing plate transverse to the rear section. The plate has a slot open to its distal end, with the slot having an enlarged region open to the distal end and a smaller insulation displacing region inward of the enlarged region. The slot is dimensioned so that when two laterally adjacent individually insulated wires are inserted therein, a first of the wires has its insulation displaced and is conductively engaged by the terminal portion in the insulation displacing region of the slot and the other of the wires is received in the enlarged region of the slot without being conductively engaged by the terminal portion.

In accordance with an aspect of this invention, a contact housing is provided having a pair of cavities each for receiving a respective one of a pair of the aforedescribed contacts in opposed facing relation to each other. The cavities are longitudinally displaced so that the terminal portions of the contacts overlap. Accordingly, a pair of closely adjacent wires are inserted in the housing between the pair of terminal portions and when the terminal portions are moved so that the wires enter the slots of the insulation displacing plates, each contact only conductively engages a respective one of the wires.

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 3 is an isometric view, partially cut away, of the grounding bracket of the plug connector assembly shown in FIGS. 1 and 2, with a cable prepared for assembly thereto;

DETAILED DESCRIPTION

Figure 1:
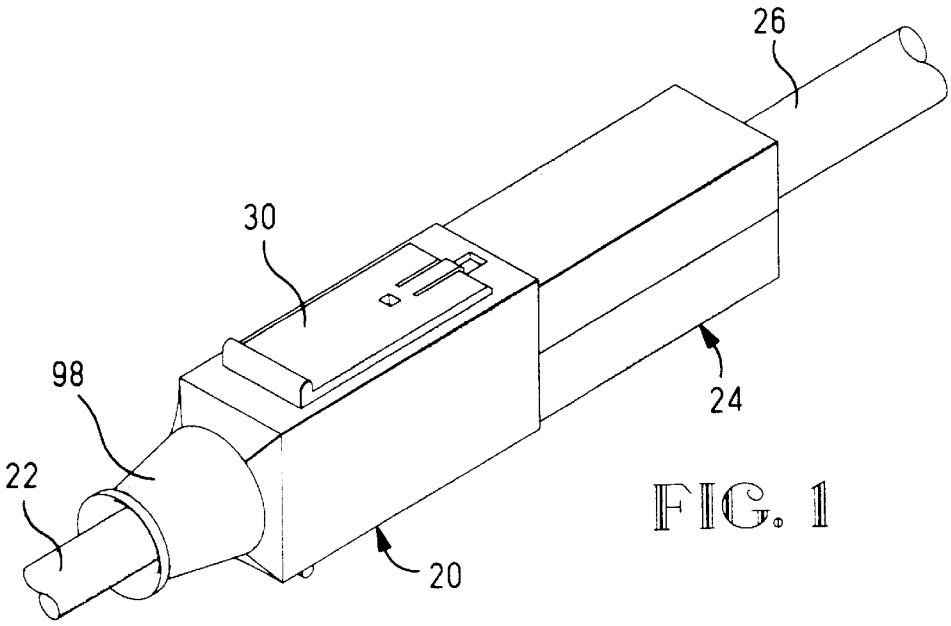
FIG. 1 is an isometric view of a connected cable plug connector assembly and cable jack assembly incorporating elements of the present invention.

Referring now to the drawings, FIG. 1 shows a plug connector assembly, designated generally by the reference numeral 20, terminating a cable 22 and matingly engaged with a jack connector assembly, designated generally by the reference numeral 24, terminating a cable 26. Illustratively, each of the cables 22, 26 includes eight individually insulated wires arranged as four twisted pairs, with each twisted pair being surrounded by a respective conductive shield of the type known as "Mylar foil", which is a laminate of a thin Mylar sheet with a thin coating of aluminum on one side. This Mylar foil is wrapped around its respective twisted pair with the aluminum foil being exposed on the outside. Surrounding the four twisted pairs is a woven copper braided shield, typically connected to ground. Optionally, a Mylar foil shield may cover the four twisted pairs underneath the braided shield. In this case, the aluminum side of the Mylar foil would again be on the outside. Covering the braided shield is an outer plastic jacket. The foregoing cable is conventional and forms no part of the present invention.

The purpose of the plug connector assembly 20 and the jack connector assembly 24 is to interconnect respective ones of the twisted pairs within the cables 22 and 26 and to maintain continuity of the grounded shields between the cables 22 and 26 when they are so interconnected. The plug connector assembly 20 is designed for factory assembly, whereas the jack connector assembly 24 may be assembled in the field by a technician.

Figure 2:
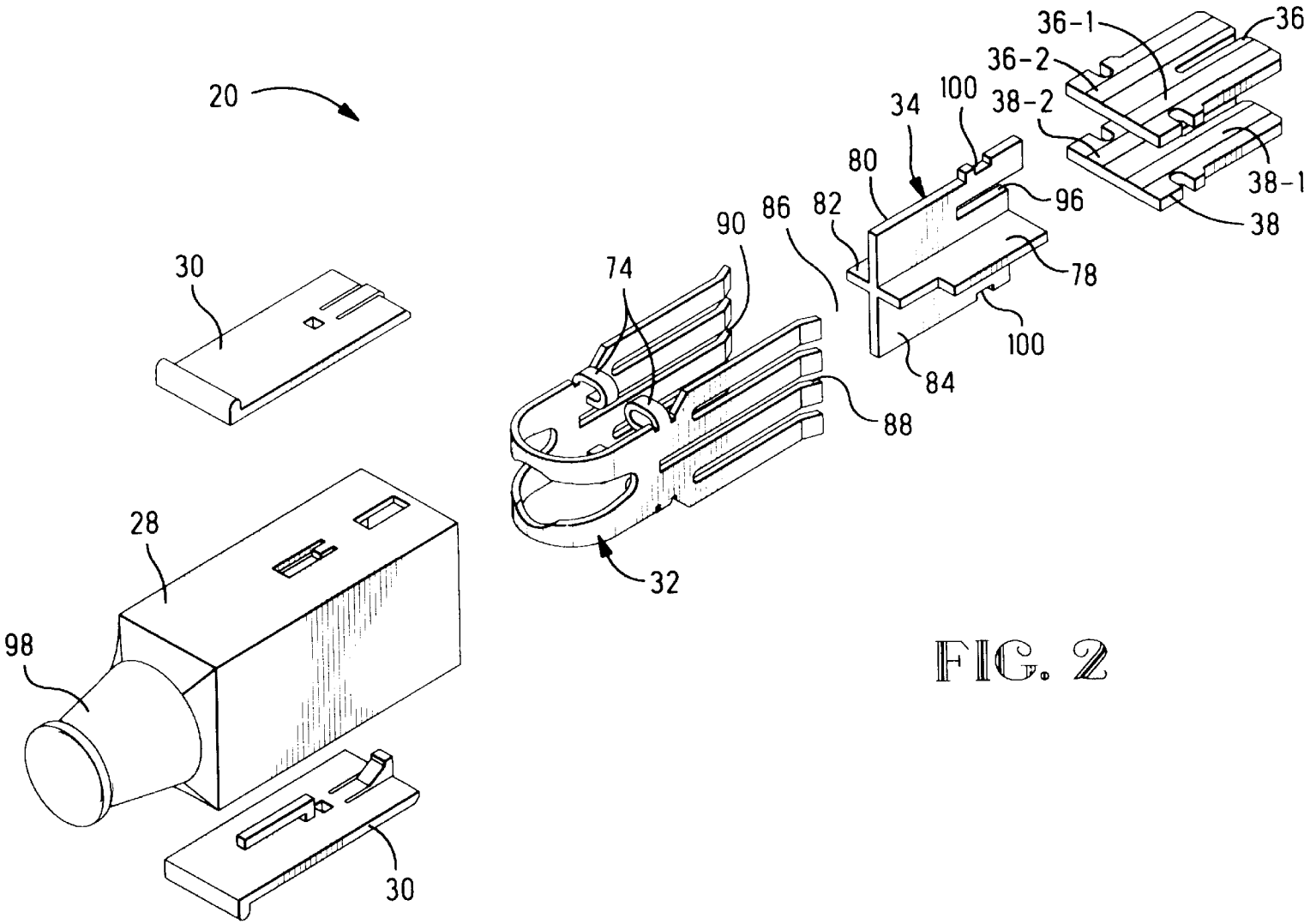
FIG. 2 is an exploded isometric view of the plug connector assembly shown in FIG. 1.

As shown in FIG. 2, the components making up the plug connector assembly 20 include an outer insulative housing 28, a pair of insulative sliding latch members 30, a conductive grounding bracket 32, a conductive interior shield member 34, and a pair of circuit boards 36, 38 which function as contact terminals for the plug connector assembly 20. Each of the circuit boards 36, 38 has deposited thereon, in a suitable manner, four elongated conductive contact traces. Thus, on the upper surface of the circuit board 36, are the conductive traces 36-1 and 36-2. Similarly, on the upper surface of the circuit board 38 are the conductive traces 38-1 and 38-2. On the opposed lower surfaces (not shown) of the circuit boards 36, 38 are a pair of similar contact traces (not shown) directly opposed to the contact traces on the upper surfaces of the boards. Thus, the circuit boards 36, 38 together provide eight contact traces, one for each of the wires in the cable 22.

As shown in FIG. 3, the cable 22 has an outer insulative jacket 40 surrounding a conductive braided shield 42 and a plurality of twisted pairs 44, illustratively four in number, each covered by its own Mylar foil shield 46. Although not shown, the twisted pairs 44 may all be covered with a common Mylar foil shield immediately inward of the braided shield 42. To terminate the cable 22 to the plug connector assembly 20, the outer jacket 40 is cut away circumferentially and covered at its end by a conductive split ring 48. Preferably, the ring 48 is split in a zig zag pattern which has been found to decrease the electrical radio frequency leakage. The braided shield 42 (and also the common Mylar foil shield if present) is folded back over the split ring 48 and any excess thereof is trimmed away. Thus, the four twisted pairs 44, each of which comprises a pair of individually insulated wires twisted tightly together and surrounded by its own Mylar foil shield 46, have a certain minimum length, required for termination, exposed and extending forwardly out of the cut end of the cable 22.

Figures 3A, 3B:
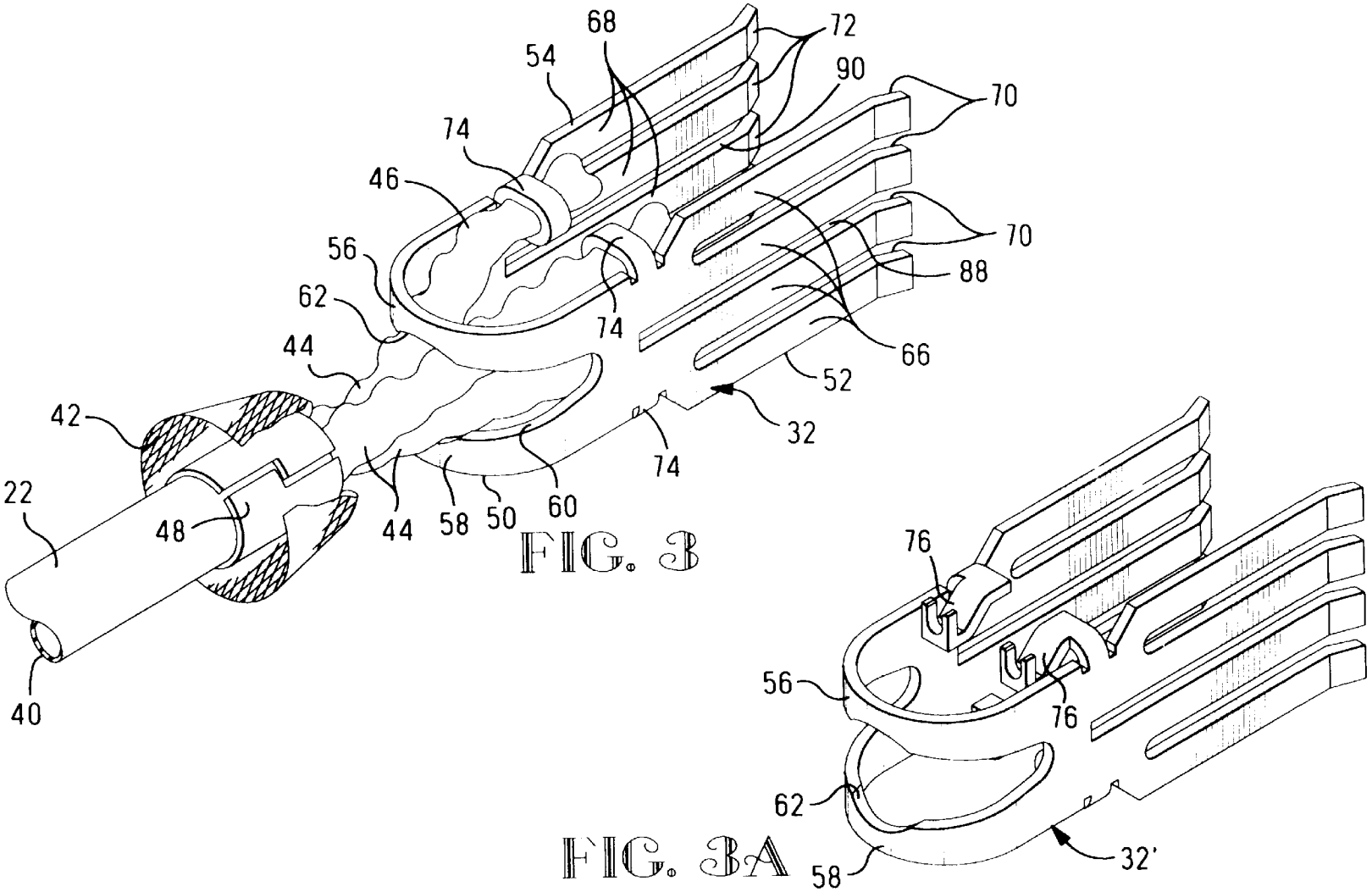
FIG. 3A is an isometric view of an alternate embodiment of the grounding bracket shown in FIG. 3.

The bracket 32 is a unitary conductive member, illustratively cut and formed from a sheet of copper alloy plated with tin-lead. As shown, the bracket 32 is formed into an overall U-shape having a closed curved end 50 and a pair of substantially straight and spaced apart portions 52, 54 extending from the closed curved end 50 each to a respective one of a pair of opposed ends. The closed curved end 50 is formed by a pair of curved bars 56, 58 which are spaced to form an elongated opening 60 between them. The opening 60 is centered at the mid point of the closed curved end 50 and is symmetrical about that mid point, with an enlarged central opening 62 (as best shown in FIG. 3A) defined by opposed generally arcuate surfaces of the bars 56, 58. The central opening 62 is sized to accept therein an end portion of the cable 22 with the braided shield 42 overlying the split ring 48. The elongated opening 60 extends at each of its ends partially into a respective one of the pair of straight portions 52, 54.

When assembling the cable 22 to the grounding bracket 32, as will be described, the end portion of the cable 22 with the braided shield 42 overlying the split ring 48 is inserted into the enlarged central opening 62. Opposing crimp forces, as indicated by the arrows 64 (FIG. 4) are applied to the curved bars 56, 58 near the ends of the opening 60, illustratively at the junctures of the closed curved end 50 with the straight portions 52, 54. The bars 56, 58 act as spring loaded cantilever beams and this crimping causes the bars 56, 58 to engage the braided shield 42 and compress the split ring 48 so as to clamp the grounding bracket 32 to the braided shield 42 while leaving stored elastic energy in the bars 56, 58. The central opening 62 provides good contact with the braided shield 42 around a substantial portion of the circumference of the braided shield 42. In the situation where a common Mylar foil shield is folded back to overlie the braided shield 42, the crimping forces will cause the bars 56, 58 to break through the thin foil and contact the braided shield 42.

The forward ends of each of the straight portions 52, 54, of the bracket 32 are formed with structure adapted for conductive engagement with a conductive housing (or shield portion) of the complementary mating jack connector assembly 24, as will be described. Preferably, this structure includes four or more parallel spaced fingers 66 on the straight portion 52 and four or more opposed parallel spaced fingers 68 on the straight portion 54. The spacing between the fingers 66 and the fingers 68 is slightly less than the outer dimension of the conductive housing of the mating jack connector assembly 24, which is receivable between the fingers 66 and the fingers 68. Accordingly, each of the fingers 66, 68 is formed at its distal end with a camming surface 70, 72, respectively, which cooperate with the forward end of the conductive housing of the jack connector assembly 24 to move each of the fingers 66, 68 outwardly as that conductive housing is received between the fingers 66 and the fingers 68.

As previously described, each of the four twisted pairs 44 is covered by a respective Mylar foil shield 46. For optimum grounding, it is desired that these shields 46 be conductively engaged by the grounding bracket 32. Accordingly, the grounding bracket 32 further includes four arms 74 (one for each of the four twisted pairs 44) extending each from a respective one of the straight portions 52, 54. Each of the arms 74 is formed at its distal end to provide a pair of spaced apart portions adapted to accept a respective one of the twisted pairs 44 therebetween. The spaced apart arm portions may subsequently be crimped together to conductively engage the Mylar foil shield 46 of the respective twisted pair 44. As shown in FIGS. 2 and 3, each of the arms 74 is rolled at its distal end into opposed relation with an intermediate portion of the arm 74 to form the pair of spaced apart portions. In the embodiment shown in FIG. 3A, the distal end of each of the arms 76 of the grounding bracket 32' is forked to form the pair of spaced apart portions between which may be inserted a respective twisted pair 44.

The conductive shield member 34 functions to shield the twisted pairs 44 from each other after removal of their respective Mylar foil shields 46. Preferably, the shield member 34 is formed as a unitary member, either of metal or of a plastic material which is subsequently metal-plated. As shown in FIG. 2, the shield member 34 includes four planar walls 78, 80, 82 and 84 which are connected together along a line 86 which extends from the cable receiving end to the forward mating end of the plug connector assembly 20. The walls 78, 80, 82, 84 extend radially outward from that line 86 so as to form a plurality of angular sectors therebetween. Preferably, the walls 78, 80, 82, 84 are equiangularly spaced to define four equal quadrants, with a respective one of the four twisted pairs 44 extending within each quadrant. The wall 78 is sized for a tight fit in the space 88 between the two central ones of the fingers 66 of the grounding bracket 32 and the wall 82 is sized for a tight fit in the space 90 between the two central ones of the fingers 68 of the grounding bracket 32. Accordingly, the shield 34 is in conductive engagement with the grounding bracket 32.

Figure 4:
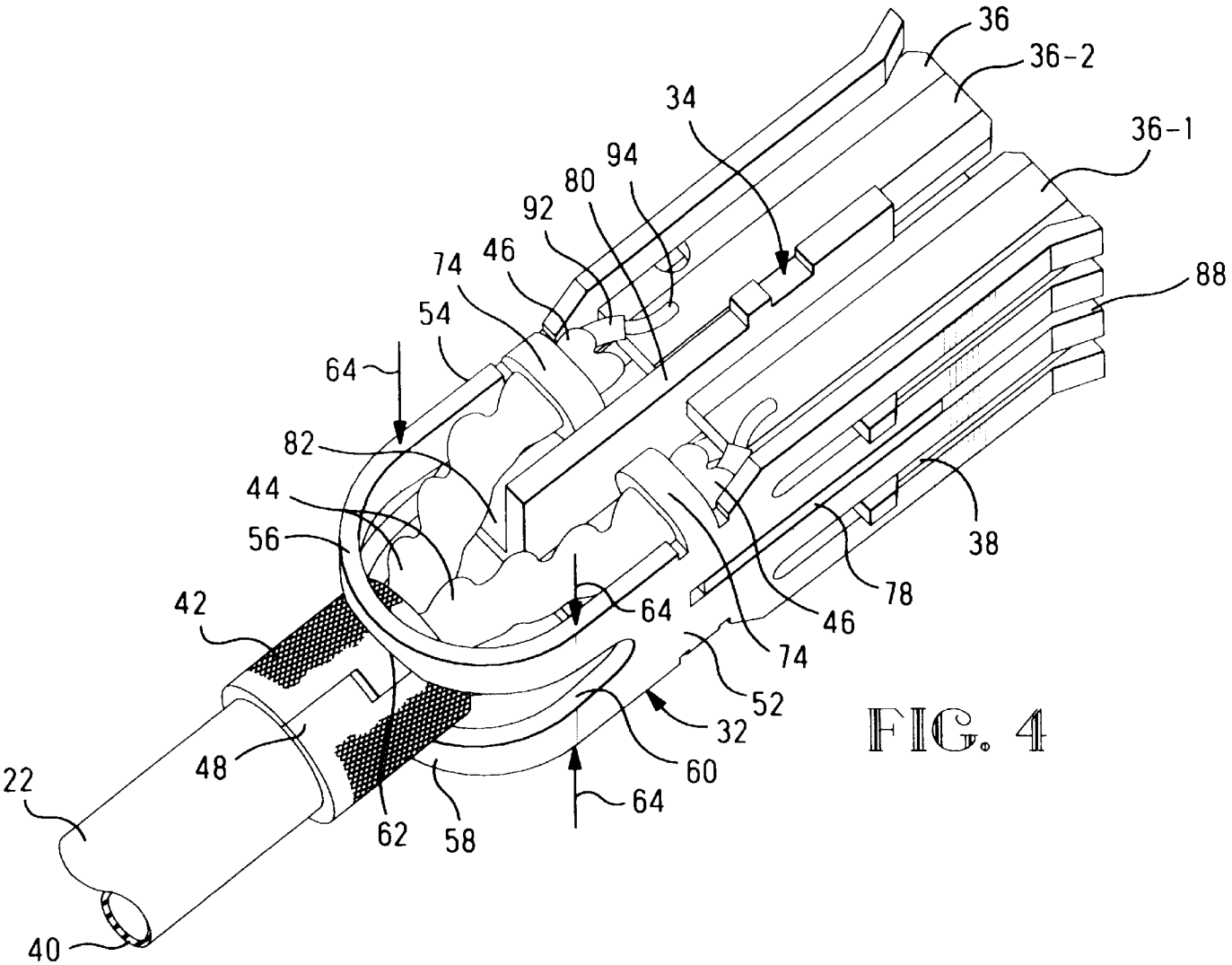
FIG. 4 is an isometric view of the assembled grounding bracket, interior shield, circuit board contacts and cable of the plug connector assembly shown in FIGS. 1 and 2.

Each of the wires of each of the twisted pairs 44 is terminated to a respective one of the contact traces on the circuit boards 36, 38. As shown in FIG. 4, the insulated wire 92 has its end 94 bared and connected to the contact trace 36-2, as by soldering or the like. The other wire of that twisted pair is connected to the contact trace on the lower surface of the circuit board 36 directly beneath the contact trace 36-2. Similar connections are made for all of the wires, and the circuit boards 36, 38 are then inserted into respective spaces between the fingers 66, and into slots 96 at the forward ends of the walls 80 and 84 of the shield member 34. It is noted that only insulative portions of the circuit boards 36, 38 contact the shield member 34.

Figure 5:
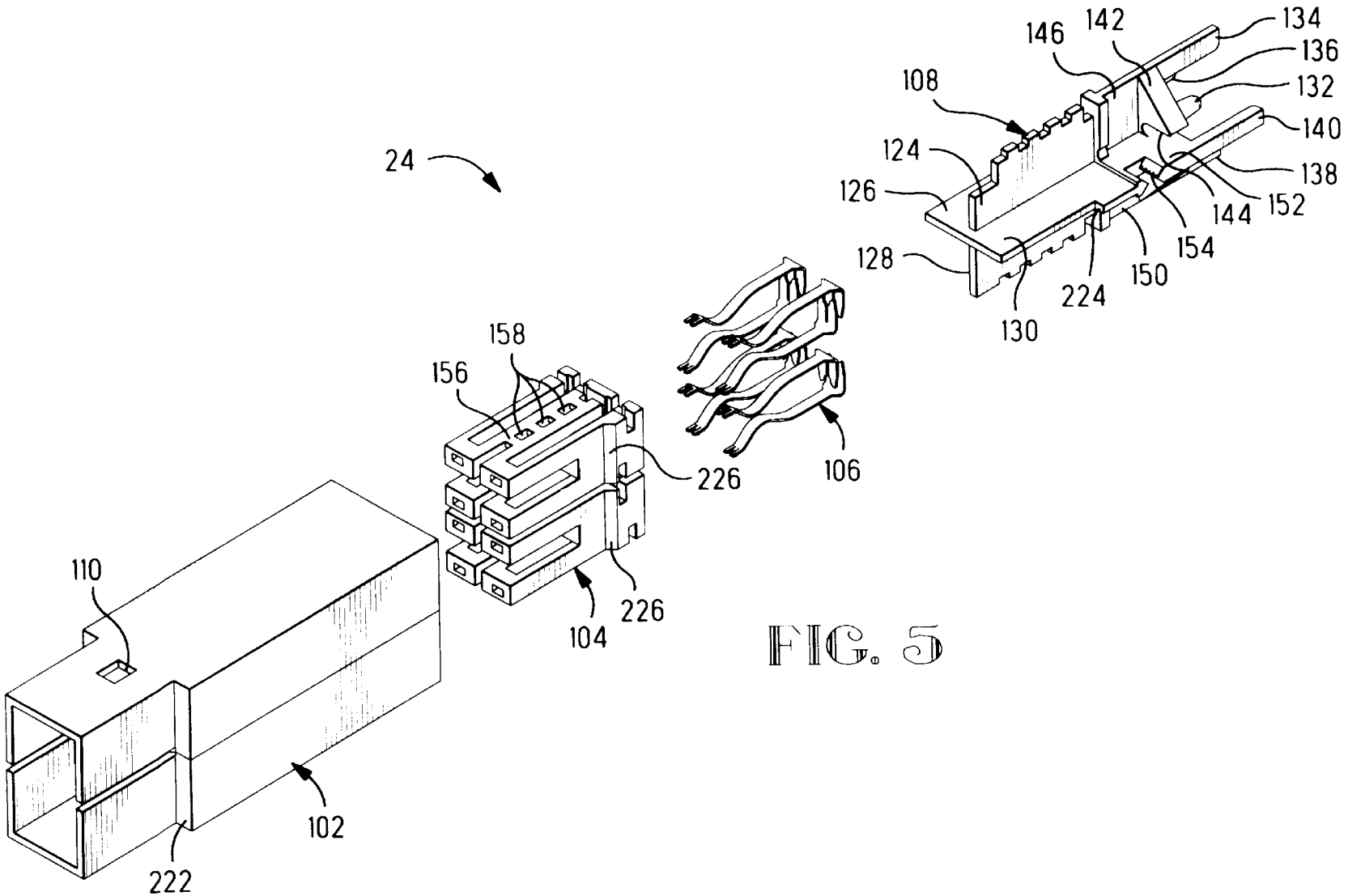
FIG. 5 is an exploded isometric view of the jack connector assembly shown in FIG. 1.

To assemble the plug connector assembly 20, the cable 22 is inserted through the strain relief 98 into the insulative housing 28 and out the forward mating end of the housing 28. The outer jacket 40 of the cable 22 is cut, the split ring 48 is placed over the cut end, and the braided shield 42 is folded back over the split ring 48 and trimmed. The cable 22 with the exposed twisted pairs 44 is inserted through the enlarged central opening 62 of the grounding bracket 32. Each of the twisted pairs 44 is inserted between spaced apart portions of a respective arm 74. An end portion of the Mylar foil shield 46 is removed from each of the twisted pairs 44 and an end 94 of each of the wires is bared. The bared ends 94 are then connected to respective contact traces on the circuit boards 36, 38 which are then slid into respective slots 96 of the shield member 34. The shield member 34 and the circuit boards 36, 38 are then installed in the grounding bracket 32 and the cable 22 is moved so that the split ring 48 with the overlying braided shield 42 is within the enlarged central opening 62 of the grounding bracket 32. The grounding bracket 32 is then crimped to secure it to the cable 22 and the arms 74 are crimped to engage the Mylar foil shields 46. The latch members 30 are installed on the housing 28 which is then slid over the assembly of the cable 22 to the grounding bracket 32 and the circuit boards 36, 38. The notches 100 in the walls 80 and 84 of the shield member 34 cooperate with structure (not shown) internal to the housing 28 to lock the assembly in place. As shown in FIG. 5, the components making up the jack connector assembly 24 include an outer conductive split housing 102, a group of insulative contact housings 104, a plurality of contact members 106 and a conductive interior shield member 108. Each of the pieces of the split housing 102 is formed with a latch opening 110 for engagement by a respective one of the latch members 30 of the plug housing 28 when the plug connector assembly 20 and the jack connector assembly 24 are mated, as shown in FIG. 1.

Figure 6:
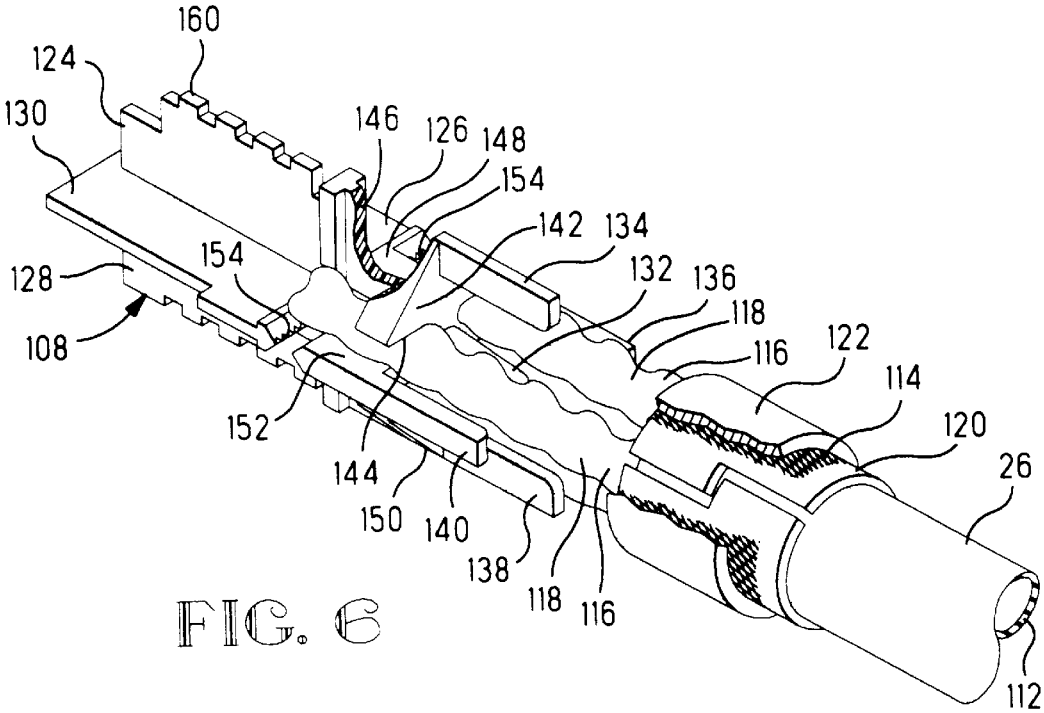
FIG. 6 is an isometric view, partially cut away, showing the assembly of a cable to the interior shield member of the jack connector assembly shown in FIGS. 1 and 5.

As shown in FIG. 6, the cable 26 is of the same type as the cable 22 and has an outer insulative jacket 112 surrounding a conductive braided shield 114 and a plurality of twisted pairs 116, each covered by its own Mylar foil shield 118. Although not shown, the twisted pairs 116 may all be covered with a common Mylar foil shield. To terminate the cable 26 to the jack connector assembly 24, the outer jacket 112 is cut away circumferentially and covered at its end by a conductive split ring 120. Preferably, the ring 120 is split in a zig zag pattern which has been found to decrease the electrical radio frequency leakage. The braided shield 114 (and also the common Mylar foil shield if present) is folded back over the split ring 120 and any excess thereof is trimmed away. A ferrule 122 is installed over the folded back braided shield 114. Thus, the four twisted pairs 116, each of which comprises a pair of individually insulated wires twisted tightly together and surrounded by its own Mylar foil shield 118, has a certain minimum length required for termination exposed and extending forwardly out of the cut end of the cable 26.

As shown in FIG. 6, the cable 26 is initially assembled to the interior shield member 108. The shield member 108, like the shield member 34, functions to shield the twisted pairs 116 from each other after removal of their respective Mylar foil shields 118. In addition, the shield member 108 insures continuity of ground between the braided shield 114 of the cable 26 and the conductive housing 102 of the jack connector assembly 24. Accordingly, the shield member 108 preferably is formed as a unitary member, either of metal or of plastic material which is subsequently metal-plated. As shown, the forward end of the shield member 108, like the shield member 34, includes four planar walls 124, 126, 128 and 130 which are connected together along a line and extend radially outward from that line so as to form a plurality of angular sectors therebetween. Like the walls of the shield member 34, the walls of the shield member 108 are preferably equiangularly spaced to define four equal quadrants, with a respective one of the four twisted pairs 116 and, as will be described hereinafter, a respective pair of the contact members 106 extending within each quadrant.

Rearwardly of the walls 124, 126, 128, 130, the shield member 108 is formed with a central rearwardly extending spike 132 and four rearwardly extending fingers 134, 136, 138 and 140 surrounding the spike 132 and substantially parallel thereto. The longitudinal axis of the spike 132 is preferably co-linear with the line along which the walls 124, 126, 128, 130 are connected. Forward of the fingers 134, 136, 138, 140, is a planar plate 142 formed with a plurality of guide slots 144 each aligned with a respective one of the quadrants defined by the planar walls 124, 126, 128, 130. The slots 144 are sized so that each shielded twisted pair may be inserted in a respective slot 144 with a tight fit. The plate 142 is orthogonal to the spike 132 and the fingers 134, 136, 138, 140 and preferably is made up of four substantially triangular pieces each secured to a respective one of four planar members 146, 148, 150 and 152 which are, in effect, extensions of respective ones of the planar walls 124, 126, 128, 130, with the fingers 134, 136, 138, 140 each being effectively an extension of a respective one of the planar members 146, 148, 150, 152 extending rearwardly beyond the planar plate 142. The planar members 146 and 150, which are diametrically opposed about the longitudinal axis of the spike 132 and are co-planar with each other, are each formed with a respective transverse cutting slot 154 formed with opposed sharpened edges, illustratively with teeth thereon.

Figure 7:
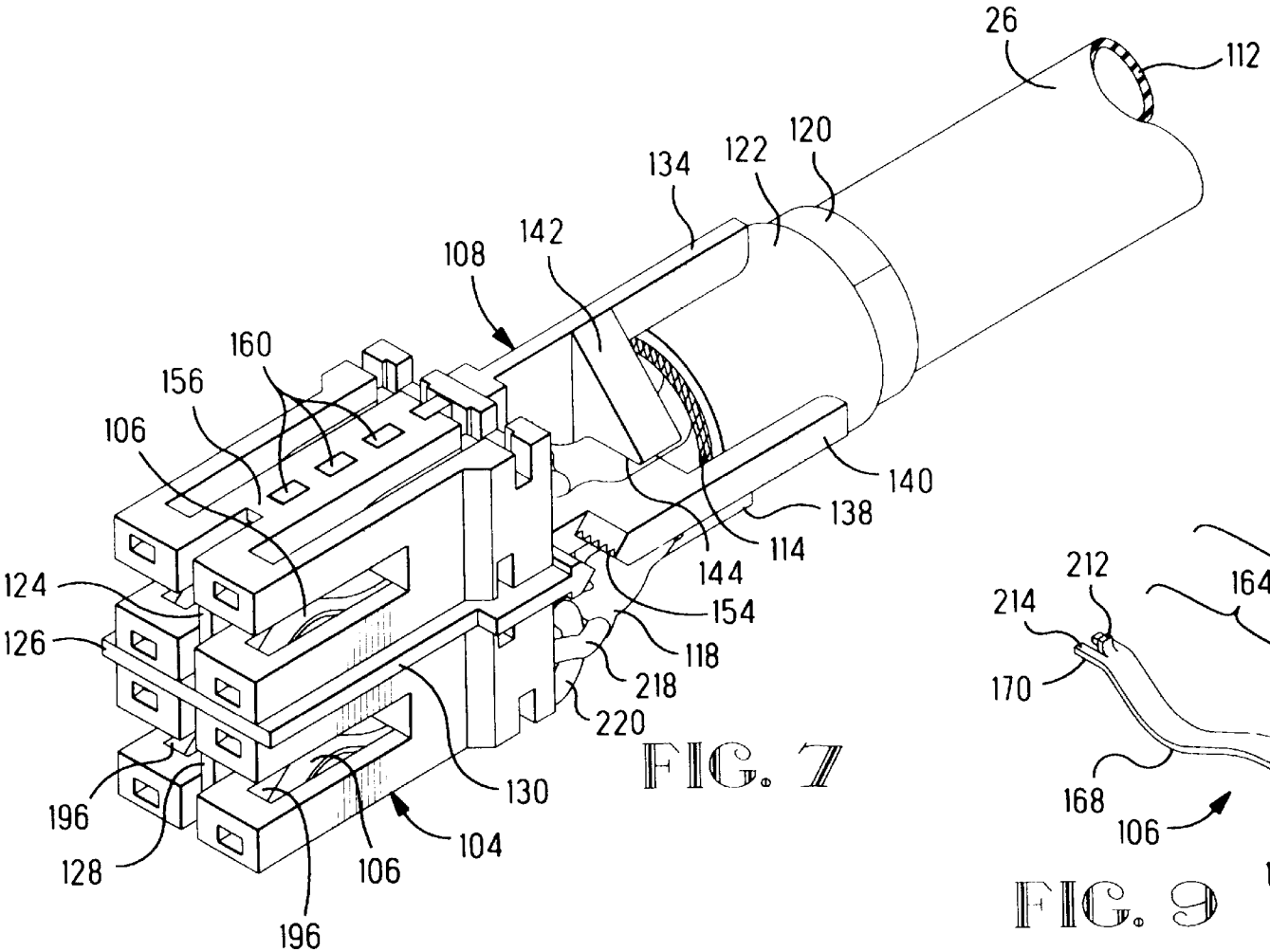
FIG. 7 is an isometric view showing the assembly of the contact members within the contact housings to the cable and interior shield member shown in FIG. 6.

To assemble the cable 26 to the shield member 108, the outer jacket 112 of the cable 26 is cut circumferentially to expose lengths of the twisted pairs 116. The split ring 120 is then installed over the outer jacket 112 at its cut end and the braided shield 114 is folded over the split ring 120 and trimmed. The ferrule 122 is then placed over the folded over braided shield 114. The twisted pairs 116 are then spread slightly apart and the spike 132 is pushed into the center of the cable 26 between all of the twisted pairs 116. This results in the fingers 134, 136, 138, 140 surrounding the ferrule 122, as best shown in FIG. 7. The spike 132 insures good conductive engagement between the shield member 108 and all of the Mylar foil shields 118. In addition, the spike 132 will provide strain relief to the cable 26 when the fingers 134, 136, 138, 140, are compressed, as will be described.

Each of the twisted pairs 116 is then installed transversely into a respective one of the guide slots 144. The tight fit within the slot 144 provides individual shield grounding for the shielded twisted pair. The twisted pair 116 is then inserted into one or the other of the cutting slots 154, depending upon which side of the walls 124, 128 that twisted pair is. The twisted pair 116 is then rubbed against the sharpened edges of the cutting slot 154, which nicks the thin Mylar foil shield 118, allowing it to be removed from the twisted pair 116 at a predetermined location thereon, rearwardly of the walls 124, 126, 128, 130. The individual wires of the twisted pairs 116 are then each terminated to a respective one of the contact members 106, as will be described.

As shown in FIG. 7, after the twisted pairs 116 are inserted into the respective guide slots 144 and have their Mylar foil shields cut in the cutting slots 154, the insulated wires of the twisted pairs 116 are terminated to respective contact members 106 held in the contact housings 104. The housings 104 are preferably molded of an insulative plastic material and illustratively are molded as units for holding four separate contact members 106, as two opposed pairs of contact members. For purposes of the present invention, it is only required that the contact housing be molded as a unit to hold a single opposed pair of contact members 106, but by molding the housings into sets of two opposed pairs, the web 156 joining the two sets of opposed pairs can be formed with spaced apertures 158 which receive therein the notched upper surface 160 of the wall 124 to align and retain the contact housings 104 on the shield member 108.

Figure 9:
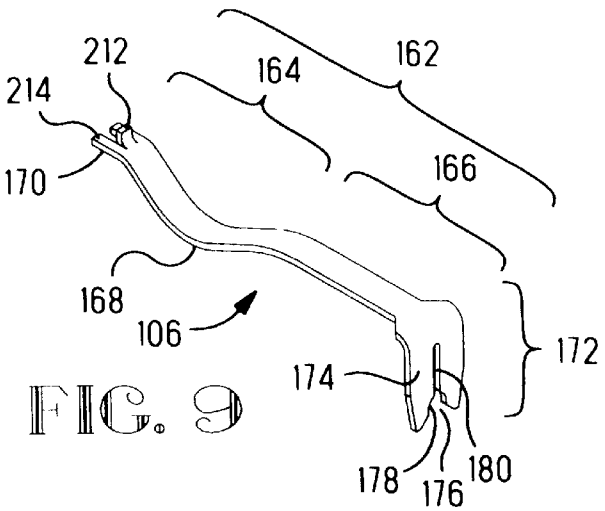
FIG. 9 is a rear isometric view of a contact member for use with the contact housing shown in FIG. 8.

FIG. 9 illustrates a contact member 106 adapted for use with the contact housing 104. When the jack connector assembly 24 is designed for terminating four twisted pairs, eight identical contact members 106 are utilized. Accordingly, each contact member 106 includes a major body portion 162 having a forward mating section 164 and a rear section 166. The forward mating section 164 includes a mating contact engaging region 168 adjacent the rear section 166 and a housing engaging portion 170 at the forward end of the contact member 106. The mating contact engaging region 168 is adapted to engage a respective conductive trace on a surface of a respective one of the circuit boards 36, 38. At the rearward end of the rear section 166, the contact member 106 is formed with a terminal portion 172. The terminal portion 172 includes an insulation displacing plate 174 which is transverse to the rear section 166 and has a slot 176 open to the distal end of the plate 174. As shown, the slot 176 has an enlarged region 178 open to the distal end of the plate 174 and a smaller insulation displacing region 180 inward of the enlarged region 178. The slot 176 is dimensioned so that when two laterally adjacent individually insulated wires forming one of the twisted pairs 116 are inserted into the slot 176, a first of the wires has its insulation displaced and is conductively engaged by the terminal portion 172 within the insulation displacing region 180 of the slot 176, and the other of the wires is received in the enlarged region 178 of the slot 176 without being conductively engaged by the terminal portion 172. Preferably, the enlarged region 178 tapers inwardly from the distal end of the plate 174 to the insulation displacing region 180 of the slot 176. This taper provides a guide surface for the wires entering the slot 176.

Figure 8:
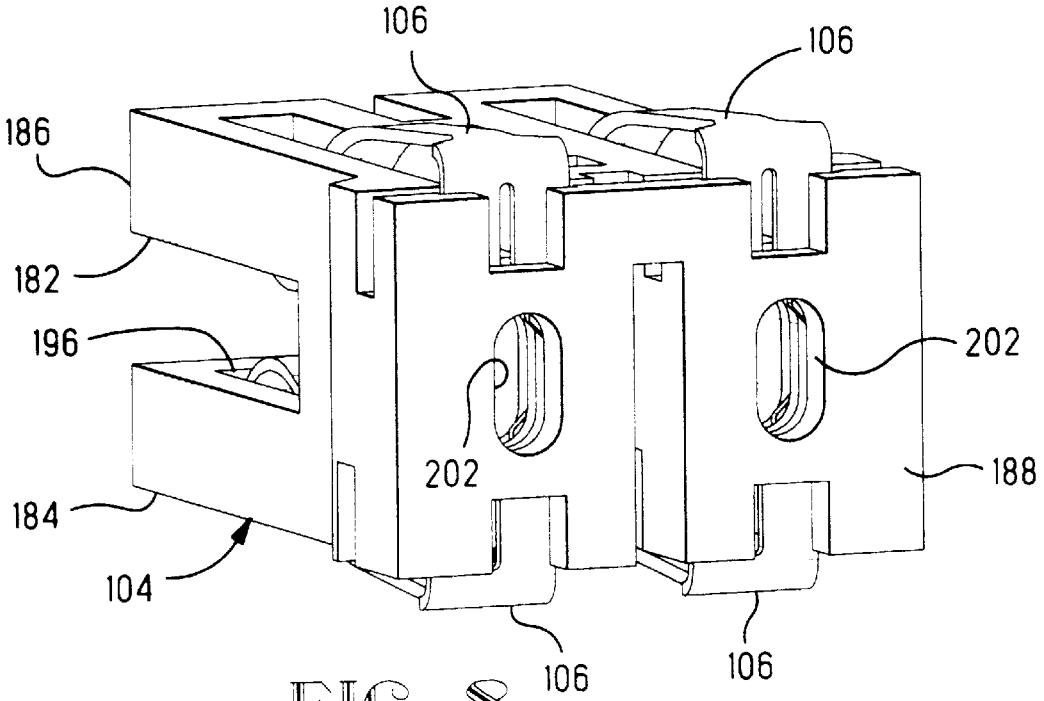
FIG. 8 is a rear isometric view of the contact housing shown in FIG. 7.

As previously mentioned, although the contact housings 104 are shown as being modules for holding four of the contact members 106, according to the present invention the contact housing 104 is required to be modular for holding two of the contact members 106 in opposed relation to engage opposed contact traces on opposite surfaces of one of the circuit boards 36, 38. Thus, as shown in FIG. 8, the contact housing 104 has an upper housing portion 182 for holding an upper contact member 106 and a lower housing portion 184 for holding a lower contact member 106, with the space between the upper and lower housing portions 182, 184 being sized to receive one of the circuit boards 36, 38 therebetween with its upper surface adjacent the upper housing portion 182 and its lower surface adjacent the lower housing portion 184. The contact housing 104 has a front mating face 186 and an opposed rear face 188. As best seen from FIG. 10, between the mating face 186 and the rear face 188, the upper housing portion 182 is formed with an upper contact receiving cavity 190 and the lower housing portion 184 is formed with a lower contact receiving cavity 192. Each of the housing portions 182, 184 is formed with a respective passageway 194, 196 extending between the respective contact receiving cavities 190, 192 and the space between the housing portion 182, 184. The contact receiving cavities 190, 192 are also open opposite the passageways 194, 196, respectively, to allow installation therein of the contact members 106, as will be described.

Figure 10:
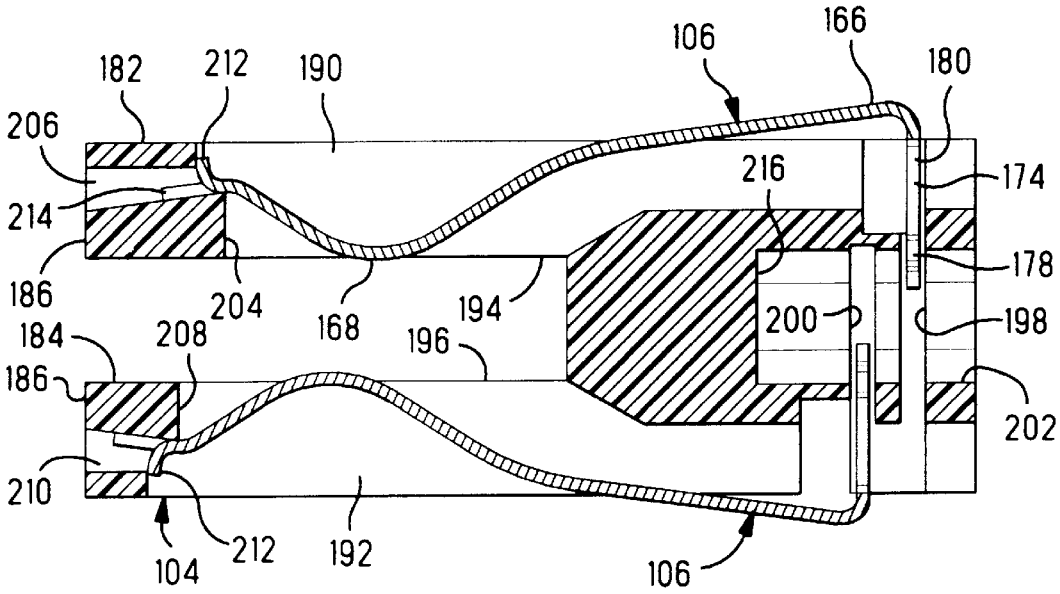
FIG. 10 is a longitudinal cross sectional view through the contact housing shown in FIG. 8, showing a pair of contact members of the type shown in FIG. 9 prior to termination to a pair of wires.
Figure 11:
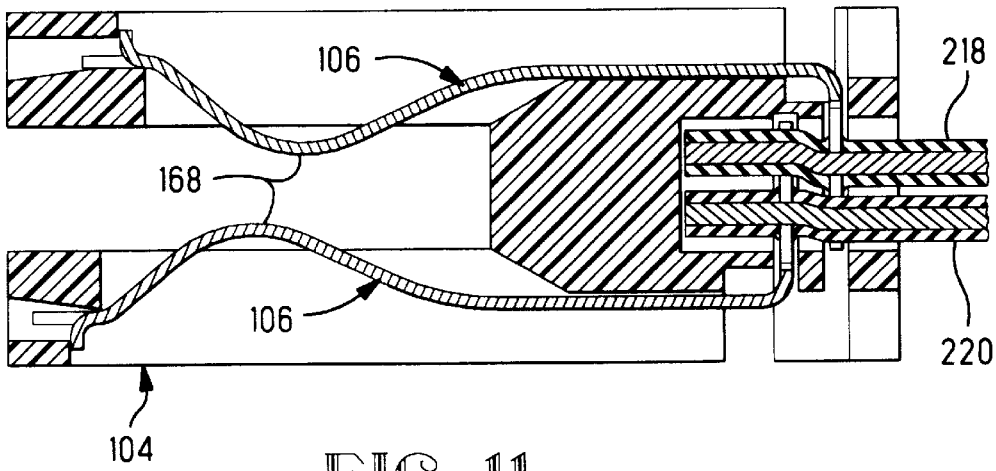
FIG. 11 is a view similar to FIG. 10 after the pair of contact members have been terminated to a pair of wires.

As best shown in FIGS. 10 and 11, the contact receiving cavities 190, 192 are offset longitudinally from each other and are arranged to hold respective contact members 106 so that the distal ends of their plates 174 are directed toward each other. Thus, at its rearward end, the upper contact receiving cavity 190 is formed with a channel 198 for the plate 174 of the upper contact member 106 and the lower contact receiving cavity 192 is formed at its rearward end with a channel 200 for the plate 174 of the lower contact member 106. It is noted that the channel 200 is parallel to and forward of the channel 198 and both of the channels 198, 200 intersect a chamber 202 extending into the housing 104 from the rear face 188. The chamber 202 is sized to receive a pair of individually insulated wires side-by-side with each wire being closer to a respective one of the contact receiving cavities 190, 192, as will be described.

At its forward end, the upper contact receiving cavity 190 is terminated by a front wall 204 and a pocket 206 extending into the front wall 204. Likewise, the lower contact receiving cavity 192 is terminated at its forward end by a front wall 208 and a pocket 210 extending into the front wall 208. To cooperate with the respective front wall 204, 208, the housing engaging portion 170 of each contact 106 is formed with a projection 212 spaced rearwardly from the front end 214 of the contact member 106 and extending transverse to the forward mating section 164.

To assemble the contact members 106 to the housing 104 and have them each terminate a respective wire of a twisted pair 116, the contact members 106 are inserted into their respective contact receiving cavities 190, 192 from the sides of the cavities 190, 192 opposite the passageways 194, 196 and with their front ends 214 being inserted into the respective pocket 206, 210. The plates 174 are inserted into the respective channel 198, 200, as shown in FIG. 10. The projection 212 interferingly engages the respective front wall 204, 208, adjacent the respective pocket 206, 210 to limit forward longitudinal motion of the respective contact member 106 within its respective contact receiving cavity 190, 192. That portion of the twisted pair 116 which has been stripped of its Mylar foil shield 118 is maintained with its tight twist to improve transmission properties and is cut to a length where the end of the Mylar foil shield 118 is aligned with a cutting slot 154 and the cut end of the twisted pair 116 is installed in the chamber 202 with its distal end closely adjacent the inner wall 216 of the chamber 202, as shown in FIG. 11.

The plates 174 of the pair of contact members 106 are then moved toward each other, the contact members 106 being pivotable on the respective front wall 204, 208 at the juncture of the respective front wall 204, 208 and the respective pocket 206, 210, so that the plates 174 move along the respective channels 198, 200. This results in the enlarged region 178 of the slot 176 of the upper contact member 106 passing the upper wire 218 and the enlarged region 178 of the slot 176 of the lower contact member 106 passing the lower wire 220. Further movement of the contact members 106 causes the insulation displacing region 180 of the slot 176 of the upper contact member 106 to cut through the insulation of the upper wire 218 and engage the inner conductive wire. Likewise, the insulation displacing region 180 of the slot 176 of the lower contact member 106 cuts through the insulation of the lower wire 220 and engages the inner conductive wire. The enlarged region 178 of the slot 176 of the upper contact member 106 receives the lower wire 220 without making electrical contact therewith. Likewise, the enlarged region 178 of the slot 176 of the lower contact member 106 receives the upper wire 218 without making conductive engagement therewith. At the same time, pivoting movement of the contact members 106 causes their mating contact engaging regions 168 to pass through their respective passageways 194, 196 for exposure in the space between the upper and lower housing portions 182, 184, for subsequent engagement with respective conductive contact traces on the surfaces of one of the circuit boards 36, 38.

To assemble the jack connector assembly 24, the outer jacket 112 of the cable 26 is cut, the split ring 120 is placed thereover, the braided shield 114 is folded over the split ring 120 and trimmed, and the ferrule 122 is placed over the folded over braided shield 114. The twisted pairs 116 are inserted through respective guide slots 144 and the cable 26, with the ferrule 122, is moved forwardly so that the spike 132 is pressed into the center of the cable between the four twisted pairs 116 and the ferrule 122 abuts the planar plate 142. The twisted pairs 116 are then each inserted into a respective one of the cutting slots 154 to nick the Mylar foil shield 118, the forward end of which is then stripped therefrom. The cutting slots 154 are located on the shield member 108 such that if the cable 26 is located correctly at the rear of the shield member 108, the cutting slots 154 will nick the Mylar foil shield 118 at the correct location for removal, thereby eliminating the need for measuring and a separate tool for nicking. In addition, the twisted pair 116 is allowed to remain together with its twist undisturbed.

While maintaining the tight twist of each twisted pair 116, each twisted pair 116 is cut at a location so that its distal end can be inserted into a respective chamber 202 closely adjacent the inner wall 216. The contacts 106 are inserted into their respective cavities 190, 192 and are pressed together to each conductively engage a respective one of the wires 218, 220. The contact housings 104 are then installed on the forward end of the shield member 108 and the two halves of the split housing 102 are placed over the contact housings 104 and the shield member 108. Since the contact housings 104 are in respective quadrants defined by the walls 124, 126, 128, 130 of the shield member 108, each pair of contact members 106 associated with a respective twisted pair 116 is shielded from all the other pairs of contact members 106. The contact housing 102 is formed with a shoulder 222 which engages the shoulder 224 of the shield member 108 and the shoulders 226 of the contact housings 104 to prevent forward longitudinal movement of the internal assembly. The split housing 102 is formed with internal features (not shown) which interferingly engage the rear of the ferrule 122 to prevent rearward longitudinal movement of the internal assembly. As the two halves of the split housing 102 are assembled together and tightened, by screws or the like (not shown), the fingers 134, 136, 138, 140 are compressed into conductive engagement with the ferrule 122. The spike 132 provides strain relief for the twisted pairs 116, prevents crushing of the cable 26, and is tightly conductively engaged by the Mylar foil shields 118. The housing 102 is conductive, so that good conductive continuity is attained between the housing 102, the shield member 108, and all the shields of the cable 26. The foregoing assembly is readily accomplished in the field by a technician.

When the plug connector assembly 20 is mated with the jack connector assembly 24, the circuit boards 36, 38 enter the spaces between the upper and lower housing portions 182, 184 of the contact housings 104 so that the conductive contact traces on opposed surfaces of the circuit boards 36, 38 engage respective ones of the mating contact engaging regions 168 of the contact members 106. At the same time, the fingers 66, 68 flank the forward end of the split conductive housing 102, being spread apart due to the camming action of the forward camming surfaces 70, 72. The resilience of the fingers 66, 68 causes them to remain in tight engagement with the conductive housing 102 so that ground continuity is attained between the cables 22 and 26.

Figure 12:
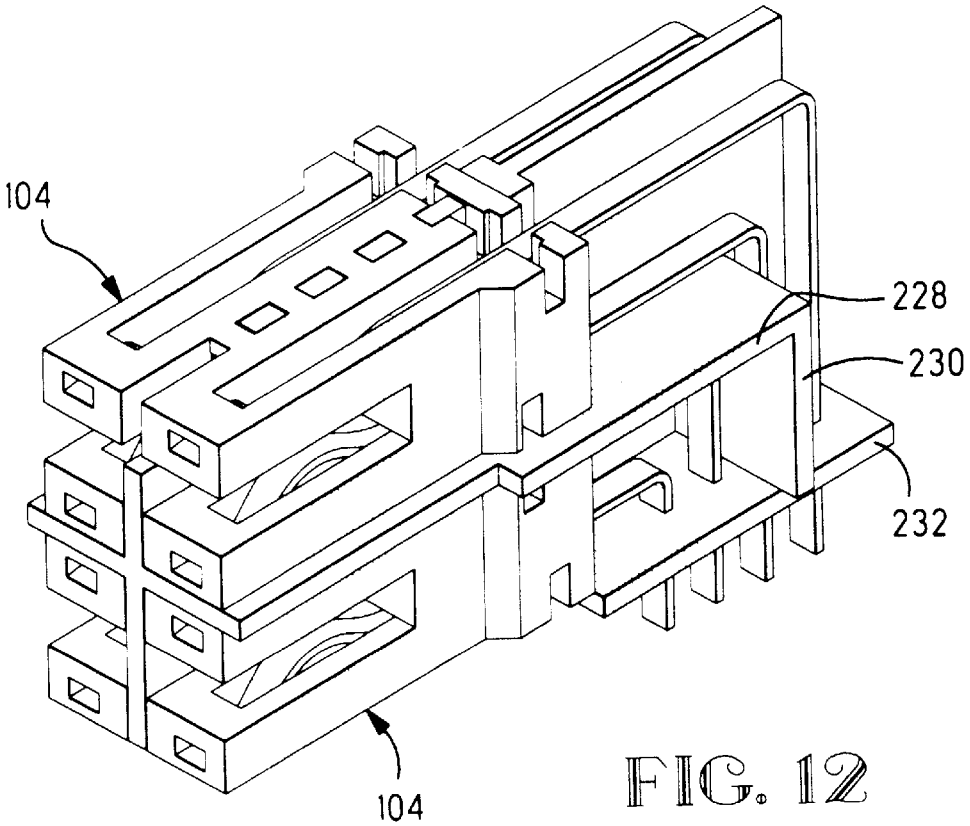
FIG. 12 is an isometric view showing the interior of a jack connector assembly similar to that shown in FIG. 5 but adapted for use as a right angled jack connector assembly for installation to a printed circuit board.

FIG. 12 illustrates an embodiment of a jack connector assembly, without housing, adapted as a right angled jack connector assembly for installation to a printed circuit board. Thus, the assembly shown in FIG. 12 includes the same contact housings 104 mounted to an interior shield member 228 having a forward end substantially the same as the forward end of the shield member 108. However, there are no cable connections so the contact members of the assembly shown in FIG. 12 do not have an insulation displacing terminal portion 172 as do the contact members 106. Instead, each of the contact members continues straight out the back of the contact housing 104 and is bent at a right angle at an appropriate distance from the rear face 188 of the contact housings 104 so that it can be secured to a printed circuit board in a conventional manner. However, the shield member 228 includes a planar member 230 which extends orthogonal to the printed circuit board (not shown) to maintain the separation of the pairs of contact members. An insulative plate 232 parallel to the printed circuit board is provided to terminate the shield member 228. The insulative plate 232 is formed with a plurality of apertures therethrough, each adapted to have a respective one of the contact members extend therethrough. The assembly shown in FIG. 12 has a conductive cover (not shown) which engages the shield member 228. When the right angled jack connector assembly is installed on a printed circuit board, the insulative plate 232 is directly on the board and the cover is connected to a ground trace on the board.

Accordingly, there have been disclosed improved plug and jack connector assemblies which insure internal shielding within the assemblies as well as ground continuity through the mated assemblies. While exemplary embodiments of the present invention have been disclosed herein, it is understood that various modifications and adaptations to the disclosed embodiments will be apparent to those of ordinary skill in the art and it is intended that this invention be limited only by the scope of the appended claims.

What is claimed is:

1. A conductive contact adapted for use in a wire pair terminating connector, comprising:

a major body portion having a forward mating section and a rear section; and a terminal portion at an end of said rear section, said terminal portion including an insulation displacing plate transverse to said rear section, said plate having a slot open to the distal end of said plate, said slot having an enlarged region open to the distal end of said plate and a smaller insulation displacing region inward of said enlarged region;

wherein said slot is dimensioned so that when two laterally adjacent individually insulated wires are inserted in said slot a first of said wires has its insulation displaced and is conductively engaged by said terminal portion in said insulation displacing region of said slot and the other of said wires is received in said enlarged region of said slot without being conductively engaged by said terminal portion.

2. The contact according to claim 1 wherein said enlarged region of said slot tapers inwardly from said distal end of said plate to said insulation displacing region of said slot.

3. The contact according to claim 1 wherein the forward mating section of said major body portion includes:

a mating contact engaging region adjacent said rear section; and a housing engaging portion at the forward end of said contact, the housing engaging portion adapted to cooperate with structure of an insulative contact housing of said connector to limit longitudinal movement of said contact within said contact housing and allow pivoting movement of said contact about an axis parallel to said plate and defined by a line of contact between said housing engaging portion and said contact housing structure;

wherein the terminal portion of said contact is pivotable about said axis to receive in said slot a pair of wires inserted in the contact housing from the rear thereof.

4. An electrical connector for terminating a pair of individually insulated wires, comprising:

an insulative housing having a mating face and an opposed rear face, said housing being formed with a pair of contact receiving cavities between said mating face and said rear face; and a pair of conductive connector contacts each in a respective housing cavity and each including:

a major body portion having a forward mating section and a rear section; and a terminal portion at an end of said rear section, said terminal portion including an insulation displacing plate transverse to said rear section, said plate having a slot open to the distal end of said plate, said slot having an enlarged region open to the distal end of said plate and a smaller insulation displacing region inward of said enlarged region;

wherein said slot is dimensioned so that when two individually insulated wires are inserted in said slot a first of said wires has its insulation displaced and is conductively engaged by said terminal portion in said insulation displacing region of said slot and the other of said wires is received in said enlarged region of said slot without being conductively engaged by said terminal portion;

wherein said pair of cavities are arranged so that the distal end of each of said plates is directed toward the other of said pair of connector contacts, said housing further includes a chamber extending into said housing from said rear face and communicating laterally with said pair of cavities in that part of each of said pair of cavities that contains a respective plate, said chamber is sized to receive said pair of individually insulated wires side-by-side with each wire closer to a respective connector contact, and said pair of cavities are offset longitudinally from each other;

whereby after said pair of individually insulated wires are received in said chamber, said pair of plates are movable toward each other so that the pair of wires are received in both of said plate slots with only the wire closest to each connector contact being conductively engaged by the terminal portion of said each connector contact.

5. The connector according to claim 4 wherein:

said housing is formed with a third cavity between said pair of contact receiving cavities and open to said mating face, said third cavity being adapted to receive therein from said housing mating face a pair of conductive mating contacts facing in opposite directions each toward a respective one of said pair of contact receiving cavities;

said housing is formed with a pair of passageways each extending between said third cavity and a respective one of said pair of contact receiving cavities; and said forward mating section of said major body portion of each of said pair of connector contacts is formed with a mating contact engaging region adjacent said rear section, and said mating contact engaging region is adapted to extend through a respective one of said passageways a sufficient distance for conductive engagement with a respective one of said pair of mating contacts inserted into said third cavity from said housing mating face.

6. The connector according to claim 5 wherein:

each of said contact receiving cavities is terminated at its forward end by a front wall and a pocket extending into said front wall from said each contact receiving cavity; and the forward mating section of the major body portion of each of said pair of connector contacts is formed with a housing engaging portion at the forward end of said each connector contact, said housing engaging portion including a projection spaced rearwardly from the front end of said each connector contact and extending transverse to the forward mating section;

wherein that portion of said each connector contact which is forward of said projection is received in a respective pocket and said projection interferingly engages the respective front wall adjacent the respective pocket to limit forward longitudinal movement of said each connector contact within the respective contact receiving cavity; and wherein said each connector contact is pivotable on the respective front wall at the juncture of the respective front wall and the respective pocket so that the mating contact engaging region of said each connector contact is moved through the respective passageway as the terminal portion of said each connector contact engages the respective wire.

* * * * *